US006964370B1

(12) United States Patent
Hagale et al.

(10) Patent No.: US 6,964,370 B1
(45) Date of Patent: Nov. 15, 2005

(54) RFID SMART OFFICE CHAIR

(75) Inventors: Anthony Richard Hagale, Austin, TX (US); Jason Ernest Kelley, Austin, TX (US); Ryan Rozich, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/912,474

(22) Filed: Aug. 5, 2004

(51) Int. Cl.[7] ..... A47C 3/03; G06K 5/00

(52) U.S. Cl. ..... 235/380; 297/217.3; 297/217.1; 235/382.5; 235/435

(58) Field of Search ..... 235/492, 380, 235/493, 435, 487, 451, 375–376, 385, 382; 701/49; 297/361.1, 217.3–217.6, 232; 73/146; 340/5.72; 455/41.2; 330/344.17, 344.2, 344.22; 312/223.1, 223.3, 233.6

(56) References Cited

U.S. PATENT DOCUMENTS 5,319,248 A * 6/1994 Endou ..... 307/10.1
6,505,780 B1 * 1/2003 Yassin et al. ..... 235/492
6,741,920 B1 * 5/2004 Otto ..... 701/49
6,748,797 B2 * 6/2004 Breed et al. ..... 73/146
6,814,410 B2 * 11/2004 Piaulet et al. ..... 297/361.1
2002/0095980 A1 * 7/2002 Breed et al. ..... 73/146
2002/0104013 A1 8/2002 Ghazarian ..... 713/200
2003/0030313 A1 * 2/2003 Rogers et al. ..... 297/344.2
2003/0142849 A1 * 7/2003 Lemelson et al. ..... 382/104
2003/0195686 A1 * 10/2003 Miller et al. ..... 701/49
2003/0204296 A1 * 10/2003 Galli et al. ..... 701/49
2004/0203379 A1 * 10/2004 Witkowski et al. ..... 455/41.2
2005/0017842 A1 * 1/2005 Dematteo ..... 340/5.72
2005/0023871 A1 * 2/2005 Cassaday ..... 297/217.3

* cited by examiner

*Primary Examiner*—Karl D. Frech
*Assistant Examiner*—Daniel Walsh
(74) *Attorney, Agent, or Firm*—Duke W. Yee; Herman Rodriguez; Stephen R. Tkacs

(57) ABSTRACT

Smart furniture is provided that automatically adjusts to a person's preferences based on an identification of the person. A person may be equipped with an identification device, such as a radio frequency identification device. The smart furniture may include a reader for the identification device to identify a person using the piece of furniture. The smart furniture may also include storage in which settings profiles of users are stored. The smart furniture may then receive a profile that matches the person using the furniture and set adjustable features according to the profile. Settings profiles may be uploaded to or downloaded from a remote storage using a wireless communications interface, such as a wireless network interface.

28 Claims, 7 Drawing Sheets

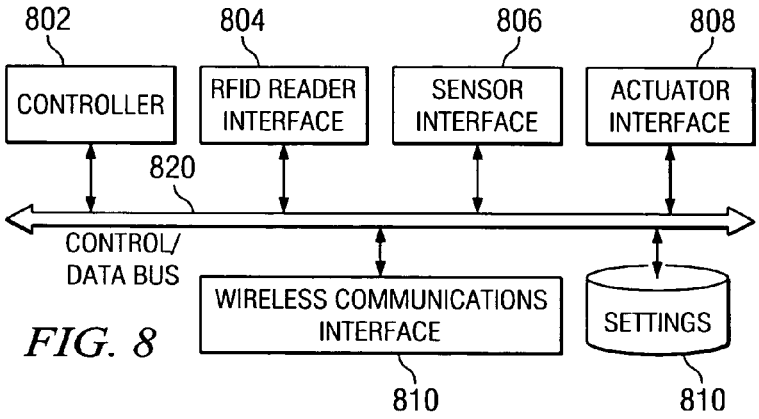
FIG. 8
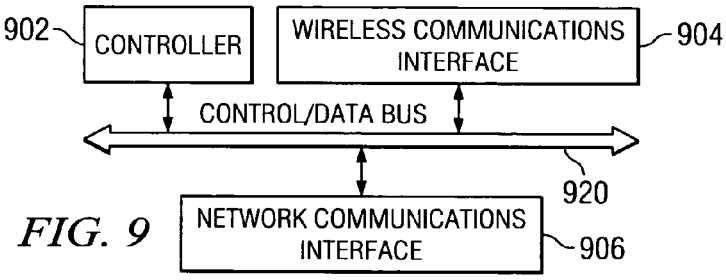
FIG. 9
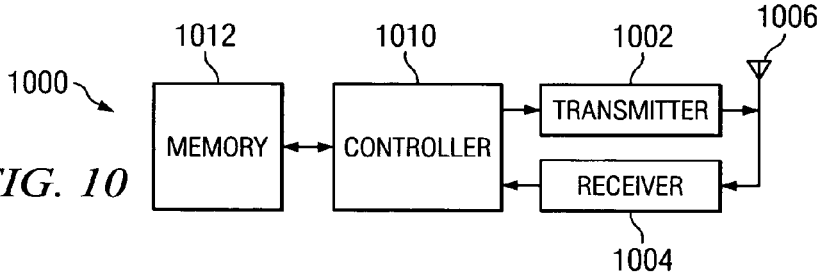
FIG. 10
SETTINGS DATABASE 1100
| PERSONAL ID | MODEL | BASE HEIGHT | BACK HEIGHT | ARM HEIGHT |
|---|---|---|---|---|
| 123456 | ABC456 | 5 | 4 | 4 |
| 123456 | XYZ111 | 6 | 3 | --- |
| 555123 | ABC456 | 4 | 5 | 5 |
| 555123 | XYZ111 | 6 | 4 | --- |
| 787878 | XYZ111 | 5 | 5 | --- |
FIG. 11

SETTINGS DATABASE
1200

| PERSONAL ID | BASE HEIGHT | BACK HEIGHT |
|---|---|---|
| 123456 | 6 | 3 |
| 555123 | 6 | 4 |
| 787878 | 5 | 5 |

RFID SMART OFFICE CHAIR

BACKGROUND OF THE INVENTION

1. Technical Field

The present invention relates to smart devices and, in particular, to a smart office chair. Still more particularly, the present invention provides a smart office chair that adjusts settings based on a radio frequency identification.

2. Description of Related Art

In a typical office space, workers may frequently move from desk to desk or meeting room to meeting room. Office chairs commonly have adjustable features, such as base height, armrest height, and the like. These adjustable features are important for the comfort of the user, particularly since ergonomics have received a great deal of attention in recent years to avoid unnecessary physical problems, such as repetitive stress disorders.

However, in a typical day, a worker may need to adjust a chair in an office, in a meeting room, in a computer lab, and perhaps in even more locations in the workplace. In addition, people may encounter furniture with adjustable features in other locations, such as one's living room, an automobile, a movie theater, an airplane, or a sports arena. Thus, in everyday life, a person may adjust features of items of furniture several times a day.

SUMMARY OF THE INVENTION

The present invention recognizes the disadvantages of the prior art and provides smart furniture that automatically adjusts to a person's preferences based on an identification of the person. In one preferred embodiment, a person may be equipped with an identification device, such as a radio frequency identification device. The smart furniture may include a reader for the identification device to identify a person using the piece of furniture. The smart furniture may also include storage in which settings profiles of users are stored. The smart furniture may then receive a profile that matches the person using the furniture and set adjustable features according to the profile. In another preferred embodiment, settings profiles may be uploaded to or downloaded from a remote storage using a wireless communications interface, such as a wireless network interface.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 8 is an exemplary functional block diagram of a RFID reader/controller in accordance with a preferred embodiment of the present invention;

FIG. 9 is an exemplary functional block diagram of an access point in accordance with a preferred embodiment of the present invention;

FIG. 10 illustrates a simple RFID device in accordance with an exemplary embodiment of the present invention;

FIG. 11 illustrates an example profile database in accordance with a preferred embodiment of the present invention;

DETAILED DESCRIPTION OF THE PREFERRED EMBODIMENT

Figure 1:
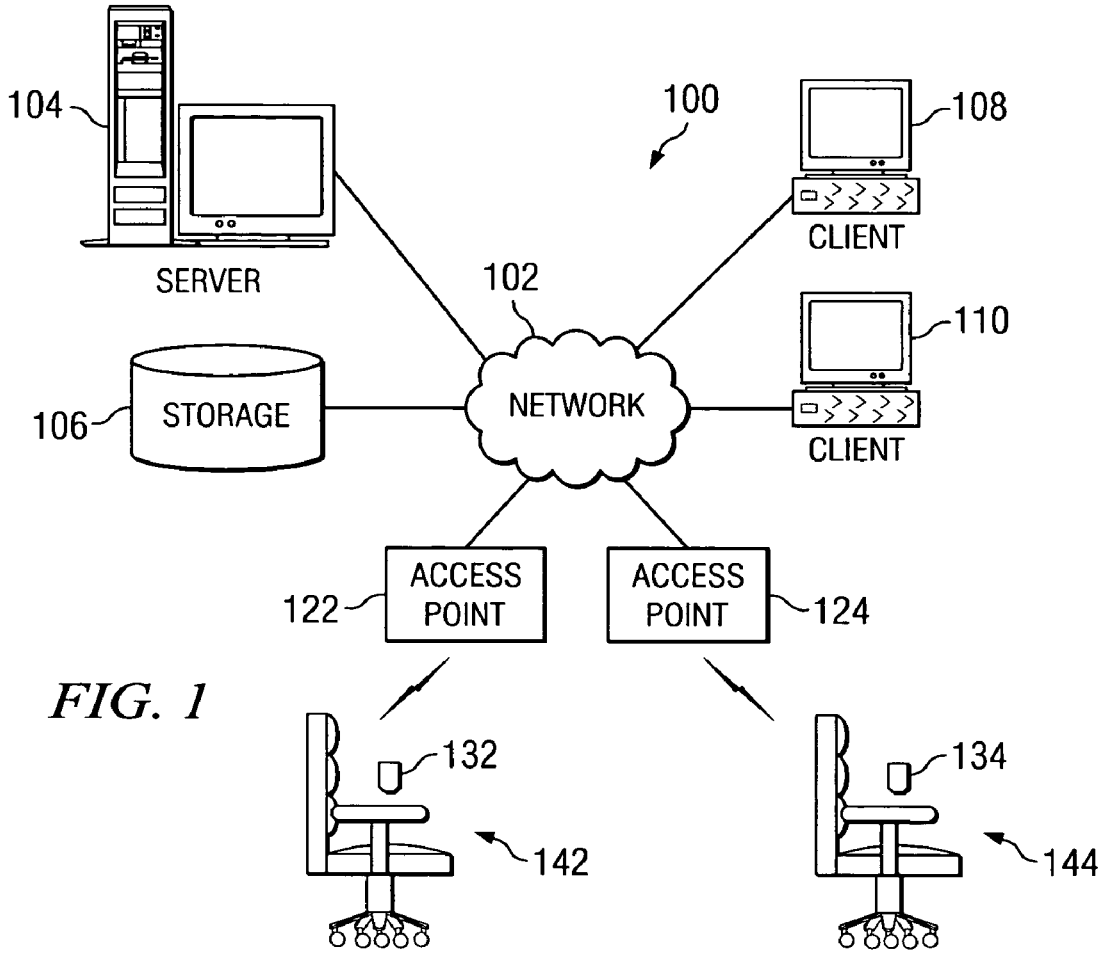
FIG. 1 depicts a pictorial representation of a network of data processing systems in which the present invention may be implemented.
Figure 2:
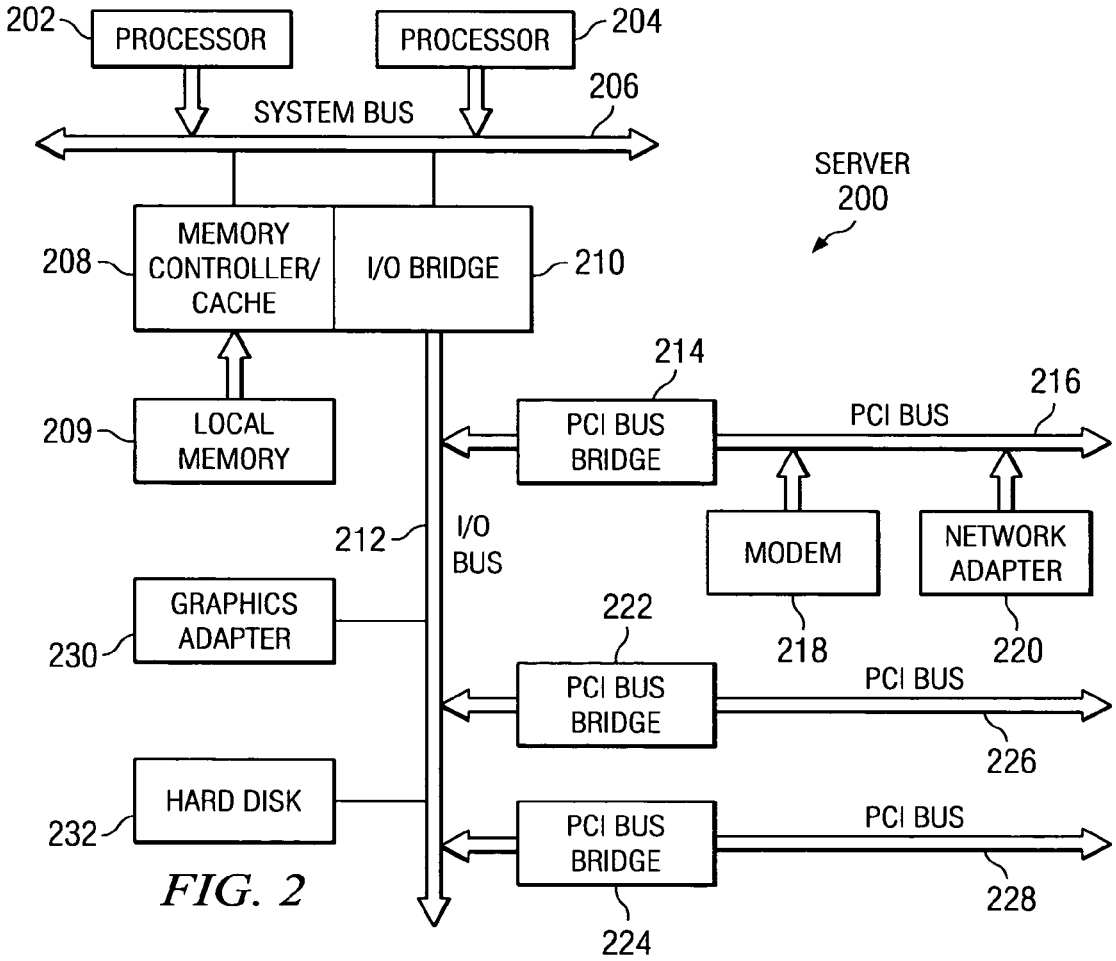
FIG. 2 is a block diagram of a data processing system that may be implemented as a server in accordance with a preferred embodiment of the present invention.
Figure 3:
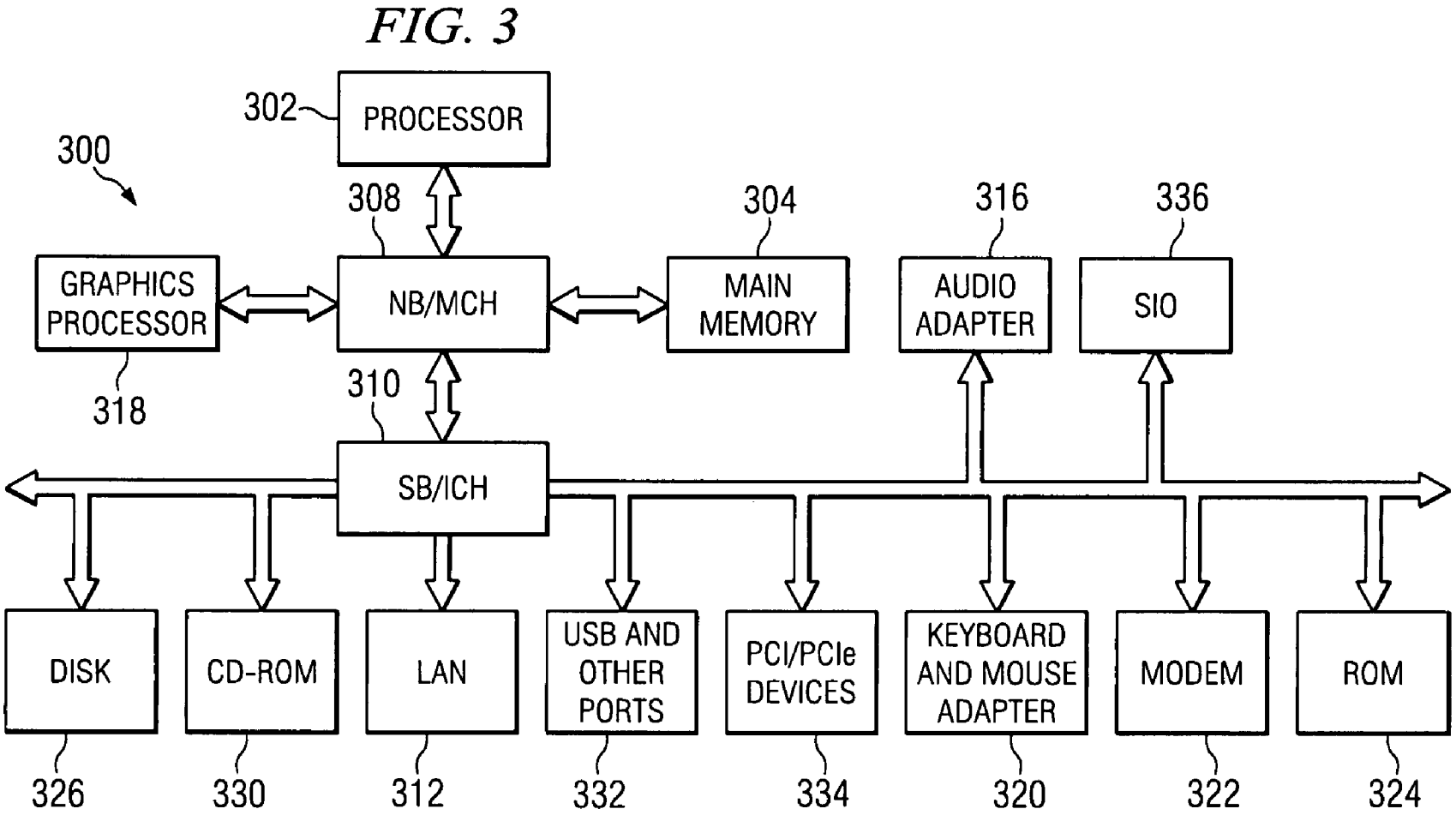
FIG. 3 is a block diagram of a data processing system in which the present invention may be implemented.

The present invention provides a smart office chair that adjusts settings based on a radio frequency identification. The smart office chair includes a data processing device that may be a stand-alone computing device or may be part of a distributed data processing system in which multiple computing devices are utilized to perform various aspects of the present invention. Therefore, the following FIGS. 1–3 are provided as exemplary diagrams of data processing environments in which the present invention may be implemented. It should be appreciated that FIGS. 1–3 are only exemplary and are not intended to assert or imply any limitation with regard to the environments in which the present invention may be implemented. Many modifications to the depicted environments may be made without departing from the spirit and scope of the present invention.

With reference now to the figures, FIG. 1 depicts a pictorial representation of a network of data processing systems in which the present invention may be implemented. Network data processing system 100 is a network of computers in which the present invention may be implemented. Network data processing system 100 contains a network 102, which is the medium used to provide communications links between various devices and computers connected together within network data processing system 100. Network 102 may include connections, such as wire, wireless communication links, or fiber optic cables.

In the depicted example, server 104 is connected to network 102 along with storage unit 106. In addition, clients 108, 110 are connected to network 102. These clients 108, 110 may be, for example, personal computers or network computers. In the depicted example, server 104 provides data, such as boot files, operating system images, and applications to clients 108, 110. Clients 108, 110 are clients to server 104. Network data processing system 100 may include additional servers, clients, and other devices not shown.

In accordance with a preferred embodiment of the present invention, items of furniture include an identification reader for reading the identification of a person. In the example shown in FIG. 1, smart office chairs 142, 144 include readers that read radio frequency identifications (RFID) 132, 134. An RFID is an electronic tag that is typically used to store identification data. An RFID tag may receive power from a reading device; however, an RFID may also operate on battery power depending upon the implementation. RFID is widely used by consumers at gas pumps, fast food restaurants, and highway toll collection systems. RFID is also used in the retail industry for product tags.

A person may carry an RFID, for example, in a wallet, in a shirt pocket, or on a key chain. Alternatively, an RFID may be embedded in an ID card or an article of clothing, such as a belt, necklace, or bracelet. RFIDs 132, 134 may be read by an RFID reader (not shown) in one of smart office chairs 142, 144, by simply being placed in proximity to the chair.

When a person carrying RFID 132 sits in smart office chair 142, for example, a reader in chair 142 reads an identification of the person and adjusts features of the chair to match a profile of the identified person. Reading of the RFID and setting of the chair may be initiated, for example, when a sensor detects that a person is sitting in the chair, when a new RFID is detected, or when a user activates a button or switch.

Smart office chairs 142, 144 may also include storage (not shown) for storing user profiles. Smart office chairs 142, 144 may receive user profiles may be from a remote location. Smart office chairs 142, 144 may also upload new profiles or modified profiles to a remote location. Smart office chairs 142, 144 may communicate with devices in network data processing system 100 through access points 122, 124.

In a preferred embodiment, storage 106 stores a central repository of user profiles. Server 104 may provide access to storage 106. Access points 122, 124 may be, for example, wireless Ethernet access points, such as a Wireless-B access point from Linksys in Irvine, Calif.; however, other wired and wireless communications may be used to upload and download user profiles between smart office chairs 142, 144 and storage 106. In an alternative embodiment, users may create or modify settings profiles through a user interface (not shown). For example, server 104 may include a Web server that provides a Web-based graphical user interface for managing smart furniture settings profiles. A user may then manage profiles using a client device, such as one of clients 108, 110.

Server 104 may manage settings profiles. Smart office chairs 142, 144 may poll server 104 for settings updates. Alternatively, server 104 may push updates to chairs 142, 144. In another alternative embodiment, users may push updates to particular smart furniture pieces using a client device. For example, a user may configure settings using a wireless-enabled personal digital assistant (PDA), for instance, and push the settings directly to a particular chair. The chair may then recognize the identity of the user and automatically make the appropriate adjustments to the settings.

In the depicted example, network data processing system 100 is the Internet with network 102 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers, consisting of thousands of commercial, government, educational and other computer systems that route data and messages. Of course, network data processing system 100 also may be implemented as a number of different types of networks, such as for example, an intranet, a local area network (LAN), or a wide area network (WAN). FIG. 1 is intended as an example, and not as an architectural limitation for the present invention.

Referring to FIG. 2, a block diagram of a data processing system that may be implemented as a server, such as server 104 in FIG. 1, is depicted in accordance with a preferred embodiment of the present invention. Data processing system 200 may be a symmetric multiprocessor (SMP) system including a plurality of processors 202 and 204 connected to system bus 206. Alternatively, a single processor system may be employed. Also connected to system bus 206 is memory controller/cache 208, which provides an interface to local memory 209. I/O bus bridge 210 is connected to system bus 206 and provides an interface to I/O bus 212. Memory controller/cache 208 and I/O bus bridge 210 may be integrated as depicted.

Peripheral component interconnect (PCI) bus bridge 214 connected to I/O bus 212 provides an interface to PCI local bus 216. A number of modems may be connected to PCI local bus 216. Typical PCI bus implementations will support four PCI expansion slots or add-in connectors. Communications links to clients 108–112 in FIG. 1 may be provided through modem 218 and network adapter 220 connected to PCI local bus 216 through add-in connectors.

Additional PCI bus bridges 222 and 224 provide interfaces for additional PCI local buses 226 and 228, from which additional modems or network adapters may be supported. In this manner, data processing system 200 allows connections to multiple network computers. A memory-mapped graphics adapter 230 and hard disk 232 may also be connected to I/O bus 212 as depicted, either directly or indirectly.

Those of ordinary skill in the art will appreciate that the hardware depicted in FIG. 2 may vary. For example, other peripheral devices, such as optical disk drives and the like, also may be used in addition to or in place of the hardware depicted. The depicted example is not meant to imply architectural limitations with respect to the present invention.

The data processing system depicted in FIG. 2 may be, for example, an IBM eServer™ pSeries® system, a product of International Business Machines Corporation in Armonk, N.Y., running the Advanced Interactive Executive (AIX™) operating system or LINUX operating system.

With reference now to FIG. 3, a block diagram of a data processing system is shown in which the present invention may be implemented. Data processing system 300 is an example of a computer, such as client 108 in FIG. 1, in which code or instructions implementing the processes of the present invention may be located. In the depicted example, data processing system 300 employs a hub architecture including a north bridge and memory controller hub (MCH) 308 and a south bridge and input/output (I/O) controller hub (ICH) 310. Processor 302, main memory 304, and graphics processor 318 are connected to MCH 308. Graphics processor 318 may be connected to the MCH through an accelerated graphics port (AGP), for example.

In the depicted example, local area network (LAN) adapter 312, audio adapter 316, keyboard and mouse adapter 320, modem 322, read only memory (ROM) 324, hard disk drive (HDD) 326, CD-ROM driver 330, universal serial bus (USB) ports and other communications ports 332, and PCI/PCIe devices 334 may be connected to ICH 310. PCI/PCIe devices may include, for example, Ethernet adapters, add-in cards, PC cards for notebook computers, etc. PCI uses a cardbus controller, while PCIe does not. ROM 324 may be, for example, a flash binary input/output system (BIOS). Hard disk drive 326 and CD-ROM drive 330 may use, for example, an integrated drive electronics (IDE) or serial advanced technology attachment (SATA) interface. A super I/O (SIO) device 336 may be connected to ICH 310.

An operating system runs on processor 302 and is used to coordinate and provide control of various components within data processing system 300 in FIG. 3. The operating system may be a commercially available operating system such as Windows XP™, which is available from Microsoft Corporation. An object oriented programming system, such as the Java™ programming system, may run in conjunction with the operating system and provides calls to the operating system from Java™ programs or applications executing on data processing system 300. "JAVA" is a trademark of Sun Microsystems, Inc.

Instructions for the operating system, the object-oriented programming system, and applications or programs are located on storage devices, such as hard disk drive 326, and may be loaded into main memory 304 for execution by processor 302. The processes of the present invention are performed by processor 302 using computer implemented instructions, which may be located in a memory such as, for example, main memory 304, memory 324, or in one or more peripheral devices 326 and 330.

Those of ordinary skill in the art will appreciate that the hardware in FIG. 3 may vary depending on the implementation. Other internal hardware or peripheral devices, such as flash memory, equivalent non-volatile memory, or optical disk drives and the like, may be used in addition to or in place of the hardware depicted in FIG. 3. Also, the processes of the present invention may be applied to a multiprocessor data processing system.

For example, data processing system 300 may be a personal digital assistant (PDA), which is configured with flash memory to provide non-volatile memory for storing operating system files and/or user-generated data. The depicted example in FIG. 3 and above-described examples are not meant to imply architectural limitations. For example, data processing system 300 also may be a tablet computer, laptop computer, or telephone device in addition to taking the form of a PDA.

Figure 4A:
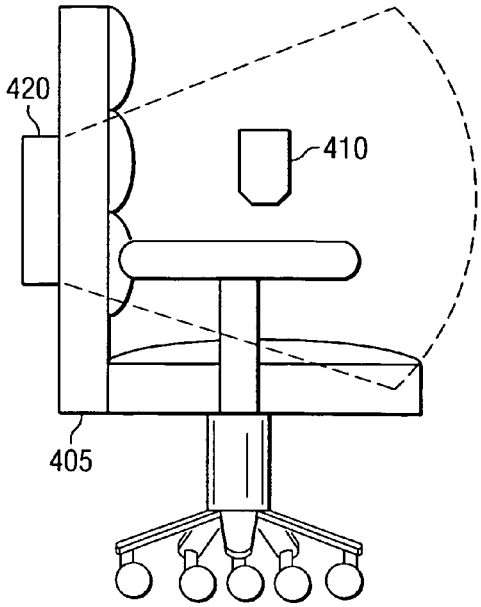
FIGS. 4A–4C illustrate reader/controller configurations for an example smart office chair, in accordance with an embodiment of the present invention.
Figure 4B:
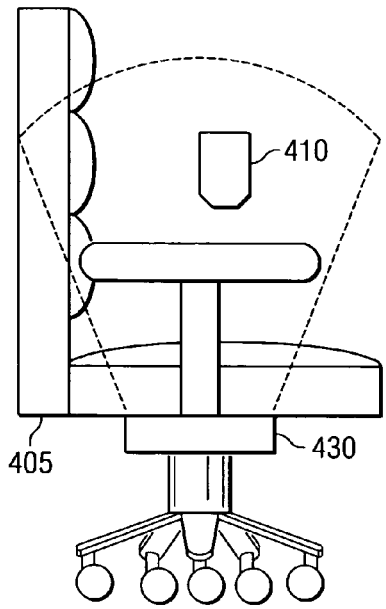
Figure 4C:
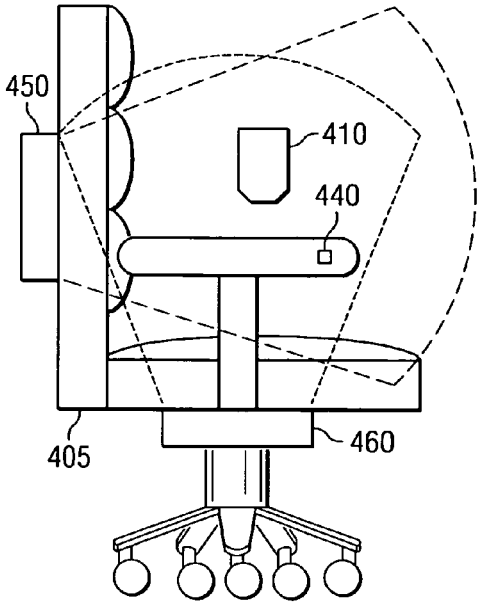

FIGS. 4A–4C illustrate reader/controller configurations for an example smart office chair, in accordance with an embodiment of the present invention. More particularly, with reference to FIG. 4A, smart office chair 405 includes RFID reader/controller 420 that acknowledges the presence of RFID 410. In the depicted example, RFID reader/controller 420 is placed on the back of chair 405. RFID reader/controller 420 reads identification information from RFID 410 and activates actuators (not shown) to set adjustable features of smart office chair 405.

RFID reader/controller 420 has a finite range that preferably encompasses an area in which an RFID may be located when a person carrying the RFID is sitting in the chair. This range is shown using a dotted line in FIG. 4A. Preferably, the range of RFID reader/controller 420 does not overlap with a range of an RFID reader of another item of smart furniture. If a conflict does arise, however, the appropriate RFID may be identified by strength of signal or by continuously reading RFIDs until only one is detected.

FIG. 4B illustrates an alternative orientation of an RFID reader/controller. In the example shown in FIG. 4B, RFID reader/controller 430 is placed on the bottom of chair 405. RFID reader/controller 430 reads identification information from RFID 410 and activates actuators (not shown) to set adjustable features of smart office chair 405. RFID reader/controller 430 has a finite range that preferably encompasses an area in which an RFID may be located when a person carrying the RFID is sitting in the chair. This range is shown using a dotted line in FIG. 4B.

FIG. 4C illustrates a further embodiment of the present invention. In this example, RFID reader 450 is located on the back of chair 405 and RFID reader 460 is located on the bottom of chair 405. The combination of RFID readers 450, 460 reads identification information from RFID 410. RFID readers 450, 460 have finite ranges that preferably overlap to encompass an area in which an RFID is likely to be located when a person carrying the RFID is sitting in the chair. The combined ranges of RFID readers 450, 460 are shown using a dotted line in FIG. 4C.

Figure 5:
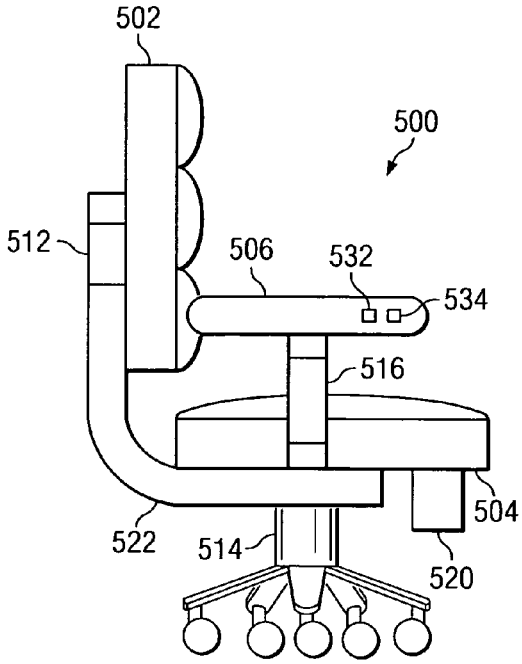
FIG. 5 illustrates an alternate view of a smart office chair with actuators for setting adjustable features in accordance with an exemplary embodiment of the present invention.

FIG. 5 illustrates an alternate view of a smart office chair with actuators for setting adjustable features in accordance with an exemplary embodiment of the present invention. Smart office chair 500 includes seat back 502, seat base 504, armrest 506, and support 522 that attaches seat back 502 to seat base 504. Seat back 502 may be adjusted up and down using actuator 512. Seat base 504 may be height adjusted using actuator 514. Armrest 506 may be adjusted using actuator 516.

Actuators 512, 514, 516 are controlled, for example, by RFID reader/controller 420 and/or RFID reader/controller 430, as shown in FIGS. 4A and 4B. The RFID reader/controller and the actuators may be powered by battery power supply 520. Actuators 512, 514, 516 may be any known type of electrical/mechanical actuators, such as hydraulic actuators, for example. Other types of actuators may include pulleys, levers, gears, or the like.

Also, as illustrated in FIG. 5, smart office chair 500 may include buttons 532, 534 for controlling the RFID reader/controller. For example, button 532 may be used to activate reading of a RFID. Alternatively, reading of a RFID may be activated using a sensor (not shown) in seat base 504 that detects when a person is sitting in chair 500. Button 534 may be used to activate recording of a chairs settings and association of the recorded settings with the identity of the user sitting in chair 500.

Figure 6:
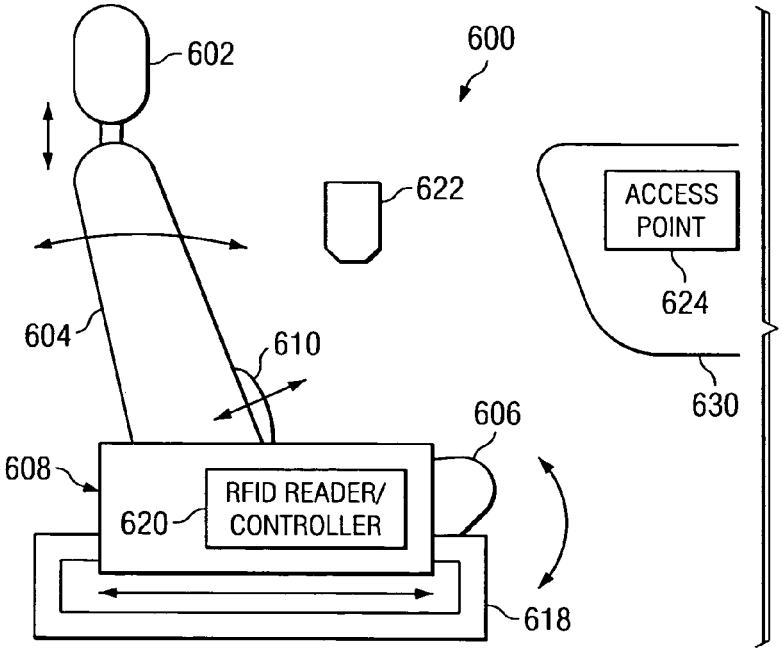
FIG. 6 is an example smart automobile seat in accordance with an embodiment of the present invention.

Turning now to FIG. 6, an example smart automobile seat is illustrated in accordance with an embodiment of the present invention. Automobile seat 600 includes base portion 608, seat portion 606, back portion 604, and headrest 602. Back portion 604 may also include lumbar support mechanism 610.

Automobile seat 600 includes actuators for moving back portion forward and back, moving headrest 602 up and down, moving seat portion 606 up and down, moving lumbar support mechanism 610 in and out, and moving the seat base portion 608 along rails 618. Automobile seat 600 also includes RFID reader/controller 620 that reads identification information from RFID 622 and activates actuators to set adjustable features of smart automobile seat 600.

RFID reader/controller 620 has a finite range that preferably encompasses an area in which an RFID may be located when a person carrying the RFID is sitting in automobile seat 600. RFID reader/controller 620 may also include memory for storing profiles for users. RFID reader/controller 620 may communicate with remote devices through access point 624, which is located in dashboard 630. Access point 624 may be, for example, a wireless Ethernet access point, such as a Wireless-B access point from Linksys in Irvine, Calif.; however, other wired and wireless communications may be used to upload and download user profiles between smart automobile seat 600 and remote devices.

As an example, access point 624 may communicate with a wireless access point or router that is part of a home network. When the automobile is parked in the garage of a person's home, access point 624 may be in range of the home network and may update preference profiles at that time. Thus, each seat of an automobile may be capable of adjusting to the preferences of any passenger. That is, a person may set preferences in the driver's seat of his own car and have those preferences apply when he sits in the passenger seat of his friend's automobile. Allowing settings profiles to be stored remotely, or even centrally on a national or world-wide level, enables settings to be propagated to any smart furniture that is capable of communicating and applying these settings.

Figure 7:
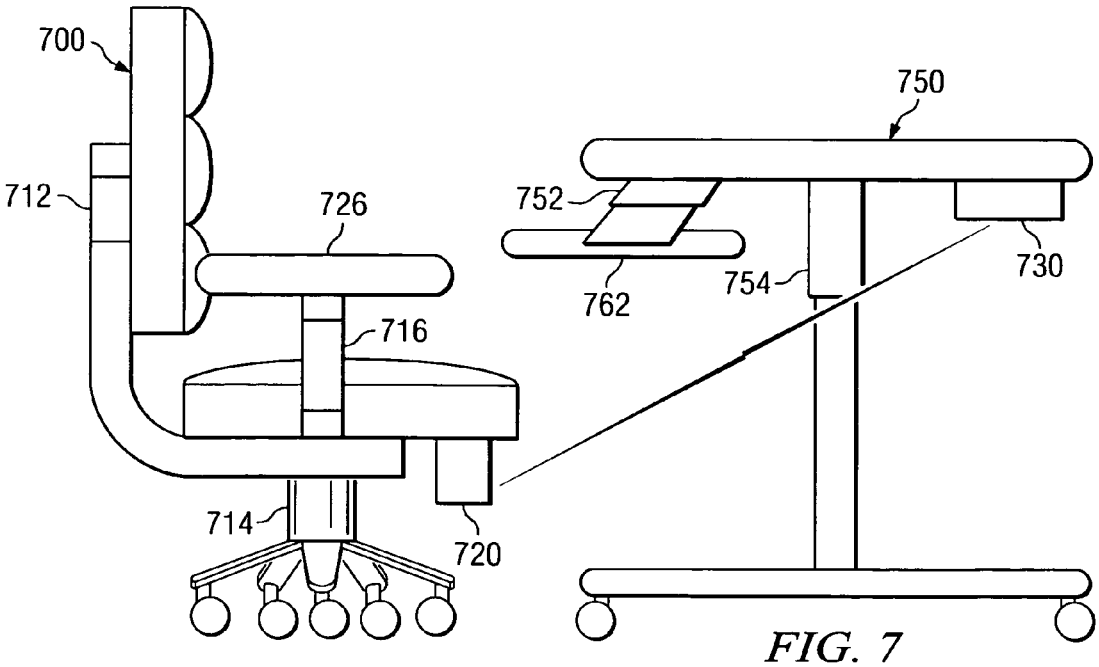
FIG. 7 illustrates interaction between items of smart furniture in accordance with an exemplary embodiment of the present invention.

FIG. 7 illustrates interaction between items of smart furniture in accordance with an exemplary embodiment of the present invention. In the depicted example, a first item of furniture, smart office chair 700, interacts with a second item of furniture, smart office desk 750. The seat back of chair 700 may be adjusted up and down using actuator 712. The seat base of chair 700 may be height adjusted using actuator 714. The armrest of chair 700 may be adjusted using actuator 716. Similarly, the top surface portion of desk 750 may be height adjusted using actuator 754 and the keyboard tray may be height adjusted using actuator 752.

Actuators 712, 714, 716 are controlled, for example, by RFID reader/controller 720. Actuators 752, 754 are controlled, for example, by RFID reader/controller 730. In an exemplary embodiment of the present invention, RFID reader/controller 720 and RFID reader/controller 730 may communicate with one another. For example, RFID reader/controller 730 may determine that RFID reader/controller 720 is within a predetermined proximity of desk 750 using, for example, a strength-of-signal determination.

RFID reader/controller 730 may also determine that chair 700 is a compatible type of furniture using a device ID, device type information, or the like. Examples of furniture that may be compatible include, for example, a chair and a desk or a chair and a meeting table. One or both items of furniture may be adjustable. For example, a desk may be adjustable to agree with the settings or dimensions of a chair. As another example, a chair may be adjustable to agree with the dimensions of a fixed meeting table. For instance, the arms of a chair may be lowered to fit under a table or desk.

In the example illustrated in FIG. 7, RFID reader/controller 720 and RFID reader/controller 730 may send settings information to one another. Settings information may include dimension information or settings of adjustable features, or both. Chair 700 may then adjust settings to agree with the settings and/or dimensions of desk 750. For example, RFID reader/controller 720 may cause actuators 716 to lower arms 726 to fit under desk 750. Alternatively, desk 750 may adjust settings to agree with the settings and/or dimensions of chair 700. For example, RFID reader/controller 730 may cause actuators 752 may raise keyboard drawer 762 to allow chair 700 to fit underneath. In yet another example, RFID reader/controller 720 and RFID reader/controller 730 may negotiate settings adjustments for both items of furniture to ensure that changes in settings are not overwhelming.

In addition, each item of smart furniture may be associated with a priority. Priority information may be included in the settings information communicated between RFID reader/controller 720 and RFID reader/controller 730. For example, desk 750 may be associated with a higher priority than office chair 700. In this case, office chair 700 will adjust features to be compatible with desk 750.

FIG. 8 is an exemplary functional block diagram of a RFID reader/controller in accordance with a preferred embodiment of the present invention. The elements of the functional block diagram of FIG. 8 may be implemented as hardware, software, or a combination of hardware and software components.

As shown in FIG. 8, the RFID reader/controller includes a controller 802, a RFID reader interface 804, a sensor interface 806, actuator interface 808, communications interface 810, and settings storage 812. These elements are in communication with one another via the control/data bus 820. Although a bus architecture is shown in FIG. 8, the present invention is not limited to such and any architecture allowing for the communication of control messages and data between the elements 802–812 may be used without departing from the spirit and scope of the present invention.

Controller 802 controls the overall operation of the RFID reader/controller. The controller detects settings of adjustable features and the presence of a user through sensor interface 806. If a user indicates that settings are to be stored, controller 802 receives sensor data from sensor interface 806 and stores the settings in settings storage 812.

When the presence of a person is detected, controller 802 receives identification information from RFID reader interface 804. Controller 802 then retrieves settings information corresponding to the ID of the person from settings storage 812. Controller 802 then applies these settings to adjustable features of the smart item of furniture through actuator interface 808.

Furthermore, controller 802 may receive updates to settings profiles through wireless communications interface 810. Updates may be received by polling a remote server, by receiving updates that are pushed by a remote server, by receiving direct updates from a client device, or by other techniques that will be readily apparent to a person of ordinary skill in the art. When updates are received, controller 802 applies these updates to settings storage 812. Controller 802 may also use settings storage 812 as a cache for the most recent settings. Thus, controller 802 may purge least recently used settings from 812.

FIG. 9 is an exemplary functional block diagram of an access point in accordance with a preferred embodiment of the present invention. The elements of the functional block diagram of FIG. 9 may be implemented as hardware, software, or a combination of hardware and software components.

As shown in FIG. 9, the access point includes a controller 902, wireless communications interface 904, and network communications interface 906. These elements are in communication with one another via the control/data bus 920. Although a bus architecture is shown in FIG. 9, the present invention is not limited to such and any architecture allowing for the communication of control messages and data between the elements 902–906 may be used without departing from the spirit and scope of the present invention.

Controller 902 controls the overall operation of the access point. The controller communicates with an RFID reader/controller through wireless communications interface 904 and routes this communications to a network through network communications interface 906. While the access point may be implemented using a well-known and readily available wireless access point, the access point of the present invention may also be implemented as a specialized device.

FIG. 10 illustrates a simple RFID device in accordance with an exemplary embodiment of the present invention. RFID 1000 includes transmitter 902 and receiver 1004 that communicate through antenna 1006. Controller receives information from receiver 1004 and transmits information through transmitter 1002. Identification information is stored in memory 1012, which may be, for example, a static memory, such as a read-only memory (ROM). When polled through receiver 1004, controller 1010 transmits identification information from memory 1012 through transmitter 1002.

FIG. 11 illustrates an example profile database in accordance with a preferred embodiment of the present invention. Settings database 1100 may store smart office chair settings for an office or may store settings information for more diverse smart furniture. For example, settings database 1100 may store world-side settings profiles for office chairs, recliners, automobile seats, airplane seats, movie theater seats, and the like. These settings may then be propagated to appropriate items of smart furniture.

Settings database 1100 may also store additional information not shown in FIG. 11. For example, settings database 1100 may store information for individual users, such as height, weight, age, and so forth. This personal information may be used to find settings profiles that most closely match an individual. For example, people of the same height and weight are likely to apply the same settings to the same model of furniture. Furthermore, people who apply the same settings to a first model of furniture are likely to apply the same settings to a second model of furniture.

Figures 12, 13:
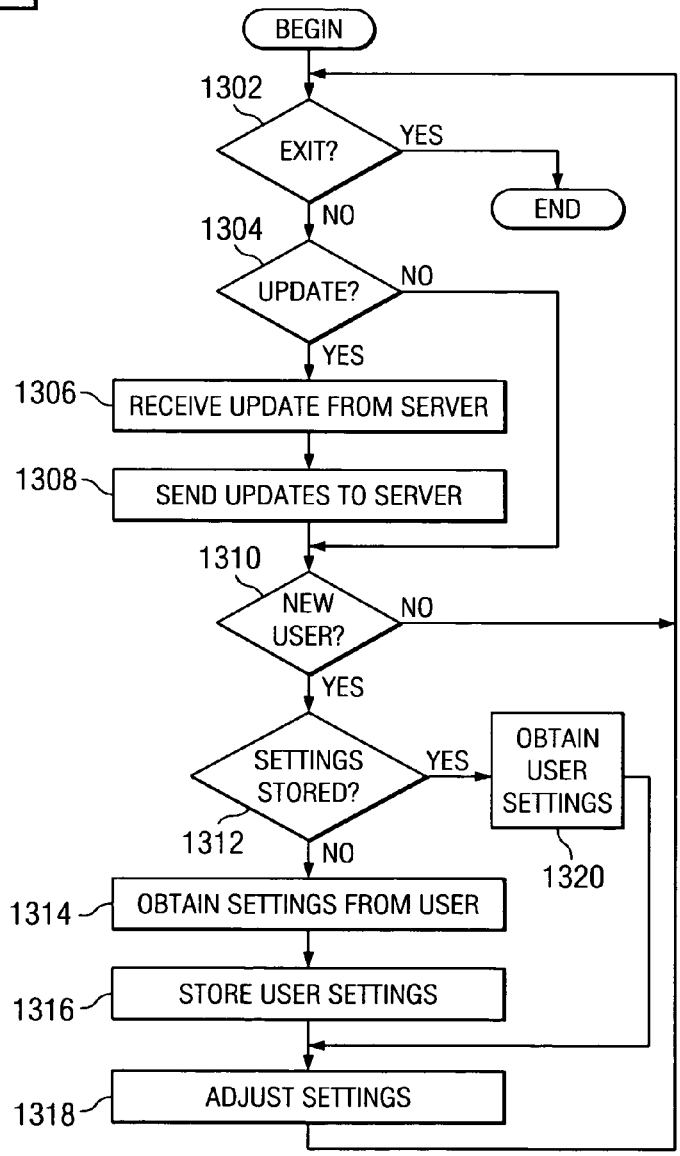
FIG. 12 illustrates an example profile database for a particular item of smart furniture in accordance with a preferred embodiment of the present invention.
FIG. 13 is a flowchart illustrating operation of an item of smart furniture in accordance with a preferred embodiment of the present invention.

FIG. 12 illustrates an example profile database for a particular item of smart furniture in accordance with a preferred embodiment of the present invention. Settings database 1200 may store smart office chair settings for all employees of an office, for example, or a predetermined number of most recent users. These settings may be updated from a remote storage or as a result of a user setting adjustable features of the item of smart furniture.

FIG. 13 is a flowchart illustrating operation of an item of smart furniture in accordance with a preferred embodiment of the present invention. Operation begins and a determination is made as to whether an exit condition exists (block 1302). An exit condition may exist, for example, when power is turned off during shutdown or a battery recharge operation. If an exit condition exists, operation ends.

If an exit condition does not exist in block 1302, a determination is made as to whether an update is received for settings profiles (block 1304). An update may be received by polling a server, for example, or when a server pushes an update to the item of smart furniture. If an update is received, the item of smart furniture receives the update from the server (block 1306) and sends updates from user adjustments to the server (1308).

Thereafter, or if an update is not received in block 1204, a determination is made as to whether a new user is detected (block 1310). A new user may be detected when an RFID is read and a new identification is detected or when a sensor indicates that a person is sitting in a chair, for example. If a new user is detected, a determination is made as to whether settings are stored for the user (block 1312).

If settings are not stored for the user, the item of smart furniture obtains settings from the user (block 1314), stores the user settings (block 1316), and adjusts the settings for adjustable features of the smart furniture (block 1318). Then, operation returns to block 1302 where a determination is made as to whether an exit condition exists. If settings are stored for the user in block 1312, the item of smart office furniture obtains the user settings (block 1320) and adjusts the settings for adjustable features of the smart furniture (block 1318). User settings may be determined in block 1320 by reading the settings from local settings storage, for example. Obtaining the settings may also include adjusting settings for the item of furniture to agree with the dimensions or settings of a related item of furniture. For example, if the item of furniture is an office chair, then settings may be adjusted to avoid conflict with the dimensions or settings of a desk. Thereafter, operation returns to block 1302 where a determination is made as to whether an exit condition exists.

Thus, the present invention solves the disadvantages of the prior art by providing smart furniture that recognizes the identity of a user and sets adjustable features based on the identity of the user. A person may be equipped with an identification device, such as a radio frequency identification device. The smart furniture may include a reader for the identification device to identify a person using the piece of furniture. The smart furniture may also include storage in which settings profiles of users are stored. The smart furniture may then receive a profile that matches the person using the furniture and set adjustable features according to the profile. Settings profiles may be uploaded to or downloaded from a remote storage using a wireless communications interface, such as a wireless network interface.

It is important to note that while the present invention has been described in the context of a fully functioning data processing system, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media, such as a floppy disk, a hard disk drive, a RAM, CD-ROMs, DVD-ROMs, and transmission-type media, such as digital and analog communications links, wired or wireless communications links using transmission forms, such as, for example, radio frequency and light wave transmissions. The computer readable media may take the form of coded formats that are decoded for actual use in a particular data processing system.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A method, in an item of smart furniture, for adjusting settings for adjustable features, the method comprising:

receiving a set of profiles, wherein each profile within the set of profiles includes first settings information for a person;

receiving identification information from a person using a first item of smart furniture;

matching the identification information with a given profile within the set of profiles;

receiving second settings information from a second item of smart furniture; and automatically setting at least one adjustable feature of the first item of smart furniture based on the first settings information in the given profile and the second settings information received from the second item of smart furniture.

2. The method of claim 1, wherein receiving identification information from a person includes reading a personalized identification device.

3. The method of claim 2, wherein the personalized identification device is a radio frequency identification device.

4. The method of claim 1, further comprising:

identifying settings of adjustable features of the first item of smart furniture in the given profile.

5. The method of claim 1, wherein receiving a set of profiles includes receiving the set of profiles from a remote server.

6. The method of claim 5, wherein receiving the set of profiles from a remote server includes receiving the set of profiles through a wireless network access point.

7. The method of claim 1, wherein automatically setting at least one adjustable feature includes causing at least one actuator to adjust a position of a portion of the first item of smart furniture.

8. The method of claim 1, wherein the second settings information includes dimensions of the second item of smart furniture.

9. The method of claim 1, wherein the second settings information includes setting values for at least one adjustable feature of the second item of smart furniture.

10. The method of claim 1, wherein the second settings information includes a priority value for the second item of smart furniture and wherein automatically setting at least one adjustable feature is performed responsive to the priority value for the second item of smart furniture being higher than a priority value for the first item of smart furniture.

11. The method of claim 1, wherein the first item of smart furniture is a chair and the second item of smart furniture is a desk.

12. The method of claim 1, wherein the first item of smart furniture is a desk and the second item of smart furniture is a chair.

13. The method of claim 1, wherein the first item of smart furniture is one of an office chair, an automobile seat, or a desk.

14. An apparatus, in an item of smart furniture, for adjusting settings for adjustable features, the apparatus comprising:

means for receiving a set of profiles, wherein each profile within the set of profiles includes first settings information for a person;

means for receiving identification information from a person using a first item of smart furniture;

means for matching the identification information with a given profile within the set of profiles;

means for receiving second settings information from a second item of smart furniture; and means for automatically setting at least one adjustable feature of the first item of smart furniture based on the first settings information in the given profile and the second settings information received from the second item of smart furniture.

15. The apparatus of claim 14, wherein the means for receiving identification information from a person includes means for reading a personalized identification device.

16. The apparatus of claim 15, wherein the personalized identification device is a radio frequency identification device.

17. The apparatus of claim 14, further comprising:

means for identifying settings of adjustable features of the first item of smart furniture in the given profile.

18. The apparatus of claim 14, wherein the means for receiving a set of profiles includes means for receiving the set of profiles from a remote server.

19. The apparatus of claim 18, wherein the means for receiving the set of profiles from a remote server includes means for receiving the set of profiles through a wireless network access point.

20. The apparatus of claim 14, wherein the means for automatically setting at least one adjustable feature includes means for causing at least one actuator to adjust a position of a portion of the first item of smart furniture.

21. The apparatus of claim 14, wherein the second settings information includes dimensions of the second item of smart furniture.

22. The apparatus of claim 14, wherein the second settings information includes setting values for at least one adjustable feature of the second item of smart furniture.

23. The apparatus of claim 14, wherein the second settings information includes a priority value for the second item of smart furniture and wherein the at least one adjustable feature are adjusted responsive to the priority value for the second item of smart furniture being higher than a priority value for the first item of smart furniture.

24. The apparatus of claim 14, wherein the first item of smart furniture is a chair and the second item of smart furniture is a desk.

25. The apparatus of claim 14, wherein the first item of smart furniture is a desk and the second item of smart furniture is a chair.

26. The apparatus of claim 14, wherein the first item of smart furniture is one of an office chair, an automobile seat, or a desk.

27. A computer program product, in a computer readable medium, for adjusting settings for adjustable features in an item of smart furniture, the computer program product comprising:

instructions for receiving a set of profiles, wherein each profile within the set of profiles includes first settings information for a person;

instruction for receiving identification information from a person using a first item of smart furniture;

instructions for matching the identification information with a given profile within the set of profiles;

instructions for receiving second settings information from a second item of smart furniture; and instructions for automatically setting at least one adjustable feature of the first item of smart furniture based on the first setting information in the given profile and the second settings information received from the second item of smart furniture.

28. The computer program product of claim 27, wherein the first item of smart furniture is one of an office chair, an automobile seat, or a desk.

* * * * *